United States Patent [19]

McGonagle

[11] 4,067,510

[45] Jan. 10, 1978

[54] TAPE DISPENSER

[76] Inventor: Hugh K. McGonagle, 1081 Edgemere Lane, Hayward, Calif. 94545

[21] Appl. No.: 732,314

[22] Filed: Oct. 14, 1976

[51] Int. Cl.[2] .....B65H 19/00

[52] U.S. Cl. ..... 242/55.2; 225/47

[58] Field of Search ..... 242/55, 55.2, 105, 75, 242/75.43; 225/24, 43, 47

[56] References Cited

U.S. PATENT DOCUMENTS

| | | | |
|---|---|---|---|
| 2,777,647 | 1/1957 | Fullerton et al. | 242/105 |
| 2,792,184 | 5/1957 | Kresser | 225/47 |
| 3,102,670 | 9/1963 | Krueger | 225/43 |
| 3,136,462 | 6/1964 | Knutson | 225/24 |
| 3,602,452 | 8/1971 | Sauer | 242/75.43 |

*Primary Examiner*—Leonard D. Christian

*Attorney, Agent, or Firm*—Warren, Chickering & Grunewald

[57] ABSTRACT

There is disclosed a dispenser for masking tape capable of dispensing indefinite lengths of tape in a straight line immediately adjacent to a molding or the like, which dispenser includes a base plate with a straight edge for contacting the molding to be abutted with tape and a rounded edge at an obtuse angle to the molding-contacting edge with the rounded edge having a terminal lip in the plane of the molding-contacting edge so that the tape can pay out over the rounded edge but cannot slide over the molding-contacting edge. The device is also provided with means to hold a spool of tape with the circular edge of the spool that is nearer the molding-contacting edge lying in a plane that includes that edge.

5 Claims, 3 Drawing Figures

TAPE DISPENSER

BACKGROUND OF THE INVENTION

The use of masking tape for painting straight lines is frequently essential. Masking tape is useful when painting moldings or surfaces that approach moldings, such as when painting the frames around window panes or when painting window frames or door frames where they meet walls. It is also necessary to paint moldings at the tops or bottoms of walls as well as numerous other situations where it is desired to paint adjacent to but not onto a portion of the surface or simply to paint a straight line.

One very satisfactory way to accomplish such a result is to use masking tape. Masking tape is well known, and it is a pressure-sensitive tape that is only mildly adhesive so that it can be removed without defacing a surface, and it is also usually impervious to paint.

Masking tape is usually applied by stripping a piece from a roll that is approximately the correct length and then holding it between the hands and maneuvering it to lie on a line immediately adjacent to the molding or wall to be painted, or if it is desired simply to paint a straight line, maneuvering it to lie on that line. Problems are frequently encountered in holding the tape so that it is applied on a straight line across its entire length; it frequently sticks to itself or to other objects where it is not desired to have the tape; and applying tape by such manner is limited to lengths of tape not in excess of the reach of the person who is applying it. The longer the piece of tape to be applied, the more difficult its application and the less likely that it will be applied as desired: i.e., in a straight line immediately adjacent to the surface to be painted and completely protecting the surface to be protected.

Another problem in the use of masking tape is applying it to protect a carpet when the baseboard at the bottom of a wall is to be painted. It is desired to fix the masking tape to the base of the carpet and to apply it so that it holds the nap of the carpet away from the wall so that a paint brush can be used at the bottom of the baseboard. Applying long pieces of masking tape in such a situation is so difficult that it is rarely even attempted.

THE INVENTION

This invention is a dispenser for masking tape which solves the foregoing problems. In this specification and in the following claims, certain terms are used for convenience that are intended to be used in a generic sense. One such term is "masking tape." Although the device of this invention is most useful in applying conventional masking tape, it is of course useful for applying any elongated adhesive material in a straight line. The term "molding" is also used in a general sense because it is the most common difficult-to-paint surface with which masking tape is used. However, the dispenser of this invention is obviously not limited to masking any particular surface in that it is suitable for applying tape in a straight line of indefinite length to any flat surface, whether the surface ends in a molding or in any other manner or indeed whether it is the edge of the surface that is to be protected rather than a portion of the center of the surface: for example, if a diagonal line across the middle of a wall were to be drawn.

Similarly, words such as "adjacent," "abutting," and "engaging" are used for convenience of expression in that masking tape is most frequently used abutting, engaging, or adjacent to the surfaces that are to be painted or otherwise treated. It is also evident that the dispenser of this invention may be employed when the ultimate objective of the tape is not to protect a surface during a painting process, but it may also be employed for applying tape for any other purpose. Accordingly, the foregoing terms and other terms of similar import are employed herein for convenience and clarity and not by way of limitation.

This invention is a dispenser for masking tape which includes a base plate having a top surface and a bottom surface. This base plate is provided with a number of edges, one of which is a molding-contacting edge which is a straight edge, preferably one of the long edges of the base plate. The base plate also has a tape-positioning edge which is an edge which intersects the contact edge at an obtuse angle. The tape-positioning edge is preferably adapted so that the side of the tape that does not contain adhesive can readily slide over it, and for this purpose it is preferably a rounded surface having a diameter of at least 2 millimeters. The tape-positioning edge terminates in a forward projection that extends beyond the positioning edge in the direction of travel. The projection preferably is a thin, flat surface that is larger than the diameter of the rounded surface of the tape-positioning edge and which surface lies in a plane that includes the extension of the contact edge.

The top surface of the base plate is provided with means to hold a spool of tape. The means includes a pedestal-like extension from the upper surface of the base plate and an axle-like piece connected to the pedestal at an obtuse angle. A rotating, circular member that is capable of holding a spool of masking tape can be positioned on the axle so that its plane of rotation is not perpendicular to the plane of the base plate. This rotating member is positioned so that a spool of masking tape may be mounted on it with the plane in which the circumferential edge of the spool near the contact edge in plane that includes that contact edge.

The device of this invention may be further adapted with a plow element that is connectable to the base plate in a manner such that it extends beyond the tape-positioning edge and is closely spaced with respect to it. It is preferred that the plow element be spaced less than two millimeters from the tape-positioning edge. The plow element is shaped so that it may contact a molding having carpeting fixed adjacent to that molding and through the action of the plow when the device of this invention is moved forward, will bend the nap to the carpeting so that masking tape may be positioned well below the upper surface of that nap and preferably positioned to adhere to the base of the carpeting through which the nap extends.

DETAILED DESCRIPTION OF THE INVENTION

This invention may be better described with reference to the accompanying drawings.

FIG. 3 illustrates an optional handle that may be employed in using this device.

Figure 1:
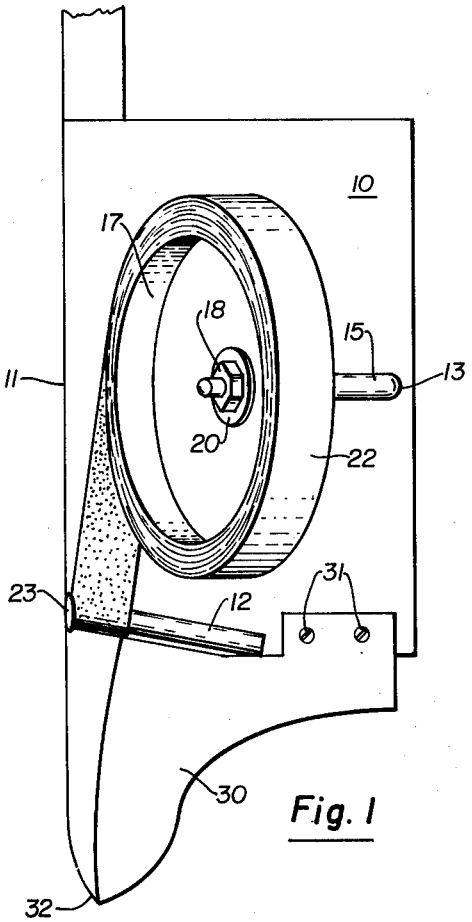
FIG. 1 is a plan view of a device embodying this invention having a plow element fixed to the front edge thereof.

All of the drawings illustrate the device of this invention containing a spool of masking tape. However, it is to be understood that the masking tape is not an element of the invention but is included in all drawings for the sake of clarity.

The figures illustrate a device including a base plate 10 that has five edges. The edge 11 is a molding-contacting edge, hereinafter referred to as a contacting edge. The edge 12 is a tape-positioning edge, hereinafter referred to as a positioning edge. The other edges of the base plate have no functional significance and will not be given numbers or names in this description. The base plate 10 has a pedestal-like means 13 fixed to it as by welding, and the pedestal-like means 13 has an axle-like element 15 fastened to it at an obtuse angle so that the element 15 extends upwardly at an angle to the plane of the base plate 10 as illustrated. A locking element 16 is fixed to the element 15 to limit the distance that a rotating spool holder 17 may move down element 15. A locknut 18 provided with a suitable washer 20 firmly holds the spool holder 17 so that it may rotate around the axis of element 15 but cannot slide up and down the element 15. The position of locking element 16 and the angle of element 15 are adapted so that the plane of the surface formed by the circumference of the spool holder 17 is a plane that includes the contact edge 11. Spool holder 17 preferably has a recessed web so that locknut 18 does not extend beyond the plane of the circumference of the spool holder 17. These relationships are best illustrated in FIG. 2.

A spool of tape 22 is illustrated mounted on rotating element 17 so that the edge of the spool of tape closer to the contact edge 11 is in the same plane as that edge of the rotating element 17. FIG. 2 shows in phantom how a wider spool of tape would be fixed to the rotating element. It is evident that tape of any width can be employed so long as it is not so wide that it will run off of the positioning edge 12 or will rub against the pedestal 13. The spool of tape is mounted so that it dispenses tape from the bottom of the spool with the adhesive side up. When it is desired to apply masking tape, enough tape is stripped from the spool 22 to pass over positioning edge 12 and under the lower surface of the base plate 10 so that it is immediately adjacent contact edge 11. In this regard, the forward projection 23, which is in the form of a thin plate, extends both above positioning edge 12 and in front of positioning edge 12, as is best shown in FIG. 1. Projection 23 guides the tape so that it cannot slide off edge 12 and it is held exactly at edge 11. The portion of projection 23 that extends above edge 12 should lean back as illustrated.

Figure 2:
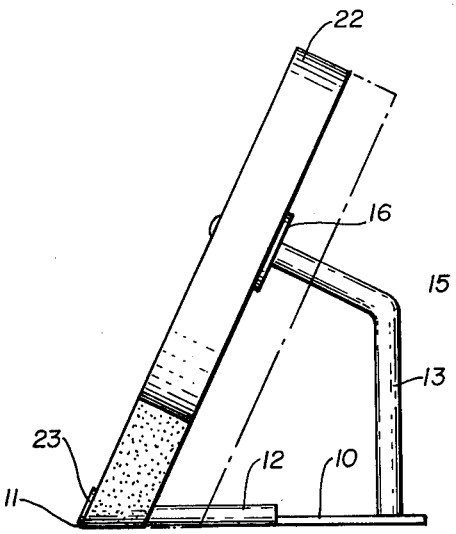
FIG. 2 is a front elevation view of the device illustrated in FIG. 1 but without the plow element.

As shown in FIGS. 1 and 2, the tape is pulled off of spool 22 until it extends beyond the rear edge of plate 10 and exactly adjacent contact edge 11. When the tape is in this position, the adhesive side is down.

To apply the tape, contact edge 11 is placed in contact with a molding, and the entire assembly is moved forward. The pressure of contact plate 10 on the tape causes the adhesive of the tape to stick to the surface beneath plate 10, and as the device is moved forward more tape pays off of spool 22, around positioning edge 12 and adjacent projection 23 so that the tape is dispensed with its edge exactly beneath edge 11 for as long as the device is advanced. When the front portion of the device reaches the extent to which the tape is to be positioned, the tape can be cut anywhere between spool 22 and positioning edge 12; and the last few centimeters of tape may be applied by hand, which is an easy process since the tape is anchored in position along its entire length. When a molding is to be painted without painting the adjacent wall, the tape is placed to adhere to the wall, and in such case the engaging edge 11 is placed in contact with the molding as the device is moved forward. Although the bottom surface of plate 10 is rather wide, the entire surface does not have to be used and it is easy to move the device of this invention, for example, by placing the bottom surface of plate 10 on a narrow molding with the engaging edge 11 in contact with the wall and advancing the device so that the narrow edge of the molding is covered with masking tape along a straight line adjacent to the wall. In such case it is the molding that is masked rather than the wall. It is evident that the device of this invention can be used with equal facility to mask glass when it is desired to paint window frames or for any other use when a length of tape is to be placed on a flat surface along a straight line.

Figure 3:
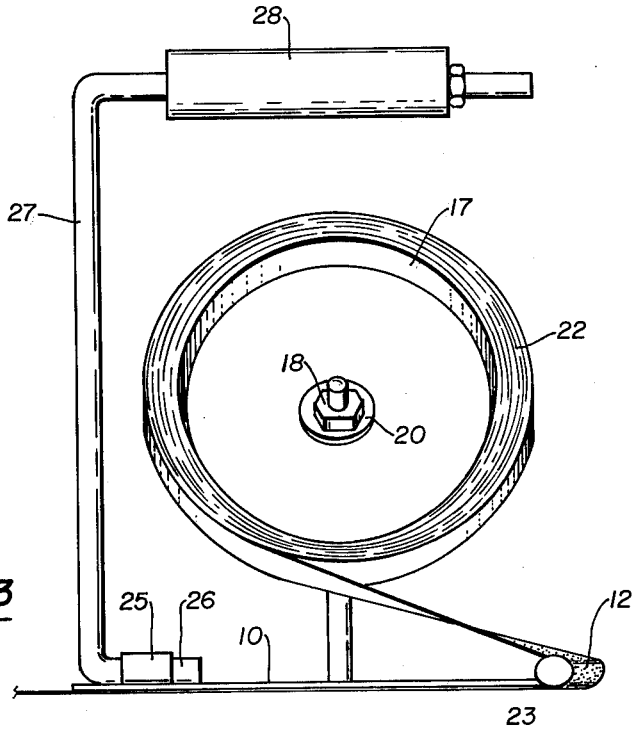
FIG. 3 is a side elevation view of the device illustrated in FIG. 1 but without the plow element.

FIG. 3 illustrates a detachable handle arrangement which can be used to increase the ease with which the device is advanced. A U-shaped element 25 is welded or otherwise fixed to the upper portion of plate 10, and an L-shaped projection 26 from a handle 27 can be engaged with the U-shaped element 25 to form a connection that is secure so long as the device is being advanced toward positioning edge 12. A handgrip 28 can be provided for such a handle if desired.

The device of this invention can also be used in conjunction with a plow element 30 which is connected with screws 31 or equivalent means to connect it to base plate 10. The plow 30 can assume any suitable shape so long as it has a leading edge 32 which can be interposed between a base molding and the nap of carpeting so that the nap of the carpeting is bent away from the base molding as the plow element 30 advances. As best illustrated in FIG. 1, the nap is laid substantially on its side when the tape-positioning edge 12 encounters the carpeting so that the contact edge 11 can apply the adhesive portion of the tape against the base of the carpeting or at least on such a low portion of the nap that paint against the nap of the carpeting would not be visible when the carpeting is restored to its normal position with the nap standing upright against the baseboard. When the device of this invention is used to mask carpeting, it will be positioned to lean toward the wall, i.e., with the plane of base 10 forming an acute angle with the plane of the wall.

There obviously are many other variations and modifications of the device of this invention that can be used within the broad scope of the invention.

What is claimed is:

1. A dispenser for masking tape comprising:

A. a base plate having a top surface, a straight molding-contact edge, and a straight tape-positioning edge intersecting said contact edge and making an obtuse angle therewith, B. a forward projection at the terminal end of said positioning edge, said projection lying in a plane that includes an extension of said contact edge, and C. a circular rotating means including a circular plane, said rotating means connected to said top surface and adapted to hold a spool of tape so that the plane of the circumference of an edge of said rotating means closer to said contact edge is not perpendicular to the plane of said base plate and the contact edge lies in that plane.

2. The dispenser of claim 1 wherein said positioning edge is rounded at a diameter of at least 2 millimeters to provide a smooth, rounded edge over which masking tape can easily slide.

3. The dispenser of claim 1 wherein a plow element is closely spaced from and in front of said positioning edge.

4. The dispenser of claim 3 wherein the spacing between said positioning edge and said plow element is less than 2 millimeters.

5. The dispenser of claim 1 including an operating handle connected to said upper surface of said base plate.

* * * * *